US007517277B2

(12) United States Patent
Muldowney

(10) Patent No.: US 7,517,277 B2
(45) Date of Patent: Apr. 14, 2009

(54) LAYERED-FILAMENT LATTICE FOR CHEMICAL MECHANICAL POLISHING

(75) Inventor: Gregory P. Muldowney, Earleville, MD (US)

(73) Assignee: Rohm and Haas Electronic Materials CMP Holdings, Inc., Newark, DE (US)

( * ) Notice: Subject to any disclaimer, the term of this patent is extended or adjusted under 35 U.S.C. 154(b) by 0 days.

(21) Appl. No.: 11/893,495

(22) Filed: Aug. 16, 2007

(65) Prior Publication Data

US 2009/0047877 A1 Feb. 19, 2009

(51) Int. Cl.
*B24D 11/00* (2006.01)

(52) U.S. Cl. ..... 451/527; 451/529; 451/532; 451/536

(58) Field of Classification Search ..... 451/285, 451/287, 526, 527, 529, 532, 531, 533, 536
See application file for complete search history.

(56) References Cited

U.S. PATENT DOCUMENTS

| | | | | | |
|---|---|---|---|---|---|
| 2,740,239 | A * | 4/1956 | Ball et al. | ..... | 451/536 |
| 2,984,052 | A * | 5/1961 | Mueller, Jr. | ..... | 451/536 |
| 3,861,892 | A * | 1/1975 | Wisdom et al. | ..... | 51/295 |
| 4,282,011 | A * | 8/1981 | Terpay | ..... | 51/298 |
| 5,131,924 | A * | 7/1992 | Wiand | ..... | 51/293 |
| 5,980,363 | A * | 11/1999 | Meikle et al. | ..... | 451/41 |
| 6,190,246 | B1 * | 2/2001 | Parrott et al. | ..... | 451/540 |
| 6,979,248 | B2 * | 12/2005 | Hu et al. | ..... | 451/28 |
| 2003/0013397 | A1 * | 1/2003 | Rhoades | ..... | 451/527 |
| 2004/0226620 | A1 | 11/2004 | Therriault et al. | | |
| 2004/0259479 | A1 | 12/2004 | Sevilla | | |
| 2006/0052040 | A1 | 3/2006 | Prasad | | |
| 2006/0116059 | A1 * | 6/2006 | Chen et al. | ..... | 451/532 |
| 2007/0190909 | A1 | 8/2007 | Muldowney | | |
| 2007/0190916 | A1 | 8/2007 | Muldowney | | |
| 2008/0026681 | A1 * | 1/2008 | Butterfield et al. | ..... | 451/527 |
| 2008/0108288 | A1 * | 5/2008 | Hu et al. | ..... | 451/548 |

* cited by examiner

*Primary Examiner*—Eileen P. Morgan
(74) *Attorney, Agent, or Firm*—Blake T. Biederman

(57) ABSTRACT

The polishing pad (104) is useful for polishing at least one of a magnetic, optical and semiconductor substrate (112) in the presence of a polishing medium (120). The polishing pad 104 includes multiple layers of polishing filaments (200, 300, 400, 500) stacked on a base layer (204, 404, 504) of polishing filaments, the multiple layers of polishing filaments (200, 300, 400, 500) having a sequential stacked formation with each layer of the polishing filaments being above and attached to a lower polishing filament, the multiple layers of polishing filaments (200, 300, 400, 500) being parallel to a polishing surface of the polishing pad (104) and wherein individual polishing filaments (202, 302, 402) of the multiple layers of polishing filaments (200, 300, 400, 500) are above an average of at least three polishing filaments (202, 302, 402), to form the polishing pad having an open lattice structure of interconnected polishing filaments (210, 310, 410, 510, 610).

10 Claims, 8 Drawing Sheets

LAYERED-FILAMENT LATTICE FOR CHEMICAL MECHANICAL POLISHING

BACKGROUND OF THE INVENTION

The present invention relates generally to the field of polishing pads for chemical mechanical polishing. In particular, the present invention is directed to a chemical mechanical polishing pad having a polishing structure useful for chemical mechanical polishing magnetic, optical and semiconductor substrates.

In the fabrication of integrated circuits and other electronic devices, multiple layers of conducting, semiconducting and dielectric materials are deposited onto and removed from a surface of a semiconductor wafer. Thin layers of conducting, semiconducting and dielectric materials may be deposited using a number of deposition techniques. Common deposition techniques in modern wafer processing include physical vapor deposition (PVD), also known as sputtering, chemical vapor deposition (CVD), plasma-enhanced chemical vapor deposition (PECVD) and electrochemical plating, among others. Common removal techniques include wet and dry isotropic and anisotropic etching, among others.

As layers of materials are sequentially deposited and removed, the uppermost surface of the wafer becomes non-planar. Because subsequent semiconductor processing (e.g., metallization) requires the wafer to have a flat surface, the wafer needs to be planarized. Planarization is useful for removing undesired surface topography and surface defects, such as rough surfaces, agglomerated materials, crystal lattice damage, scratches and contaminated layers or materials.

Chemical mechanical planarization, or chemical mechanical polishing (CMP), is a common technique used to planarize or polish workpieces such as semiconductor wafers. In conventional CMP, a wafer carrier, or polishing head, is mounted on a carrier assembly. The polishing head holds the wafer and positions the wafer in contact with a polishing layer of a polishing pad that is mounted on a table or platen within a CMP apparatus. The carrier assembly provides a controllable pressure between the wafer and polishing pad. Simultaneously, a slurry or other polishing medium is dispensed onto the polishing pad and is drawn into the gap between the wafer and polishing layer. To effect polishing, the polishing pad and wafer typically rotate relative to one another. As the polishing pad rotates beneath the wafer, the wafer sweeps out a typically annular polishing track, or polishing region, wherein the wafer's surface directly confronts the polishing layer. The wafer surface is polished and made planar by chemical and mechanical action of the polishing layer and polishing medium on the surface.

The interaction among polishing layers, polishing media and wafer surfaces during CMP has been the subject of increasing study, analysis, and advanced numerical modeling in the past ten years in an effort to optimize polishing pad designs. Most of the polishing pad developments since the inception of CMP as a semiconductor manufacturing process have been empirical in nature, involving trials of many different porous and non-porous polymeric materials. Much of the design of polishing surfaces, or layers, has focused on providing these layers with various microstructures, or patterns of void areas and solid areas, and macrostructures, or arrangements of surface perforations or grooves, that are claimed to increase polishing rate, improve polishing uniformity, or reduce polishing defects (scratches, pits, delaminated regions, and other surface or sub-surface damage). Over the years, quite a few different microstructures and macrostructures have been proposed to enhance CMP performance.

For conventional polishing pads, pad surface "conditioning" or "dressing" is critical to maintaining a consistent polishing surface for stable polishing performance. Over time the polishing surface of the polishing pad wears down, smoothing over the microtexture of the polishing surface-a phenomenon called "glazing". The origin of glazing is plastic flow of the polymeric material due to frictional heating and shear at the points of contact between the pad and the workpiece. Additionally, debris from the CMP process can clog the surface voids as well as the micro-channels through which slurry flows across the polishing surface. When this occurs, the polishing rate of the CMP process decreases, and this can result in non-uniform polishing between wafers or within a wafer. Conditioning creates a new texture on the polishing surface useful for maintaining the desired polishing rate and uniformity in the CMP process.

Conventional polishing pad conditioning is achieved by abrading the polishing surface mechanically with a conditioning disk. The conditioning disk has a rough conditioning surface typically comprised of imbedded diamond points. The conditioning disk is brought into contact with the polishing surface either during intermittent breaks in the CMP process when polishing is paused ("ex situ"), or while the CMP process is underway ("in situ"). Typically the conditioning disk is rotated in a position that is fixed with respect to the axis of rotation of the polishing pad, and sweeps out an annular conditioning region as the polishing pad is rotated. The conditioning process as described cuts microscopic furrows into the pad surface, both abrading and plowing the pad material and renewing the polishing texture.

Although pad designers have produced various microstructures and configurations of surface texture through both pad material preparation and surface conditioning, existing CMP pad polishing textures are less than optimal in two important aspects. First, the actual contact area between a conventional CMP pad and a typical workpiece under the applied pressures practiced in CMP is small—usually only a few percent of the total confronting area. This is a direct consequence of the inexactness of conventional surface conditioning that amounts to randomly tearing the solid regions of the structure into tatters, leaving a population of features, or asperities, of various shapes and heights of which only the tallest actually contact the workpiece. Second, the space available for slurry flow to convey away polish debris and heat occupies a thin layer at the pad surface such that polishing waste remains in close proximity with the workpiece until it passes completely out from under the workpiece. Slurry flow between the pad and workpiece must pass across the highly irregular surface and around any asperities that bridge the full vertical distance from the pad to the workpiece. This results in a high probability that the workpiece is re-exposed to both spent chemistry and material previously removed. Thus conventional pad microstructures are not optimal because contact mechanics and fluid mechanics within the surface texture are coupled: the height distribution of asperities favors neither good contact nor effective fluid flow and transport.

Defect formation in CMP has origins in both shortcomings of conventional pad microstructure. For example, Reinhardt et al., in U.S. Pat. No. 5,578,362, disclose the use of polymeric spheres to introduce texture into a polyurethane polishing pad. Although exact defect formation mechanisms are incompletely understood, it is generally clear that reducing defect formation requires minimizing extreme point stresses on the workpiece. Under a given applied load or polish pressure, the actual point contact pressure is inversely proportional to the true contact area. A CMP process running at 3 psi (20.7 kPa) polish pressure and having 2% real contact area across all asperity tips actually subjects the workpiece to normal stresses averaging 150 psi (1 MPa). Stresses of this magnitude are sufficient to cause surface and sub-surface damage. Being blunt and irregular in shape, asperities on conventional CMP pads also lead to unfavorable flow patterns: localized pressures of fluid impinging on asperities can be significant, and regions of stagnant or separated flow can lead to accumulation of polish debris and heat or create an environment for particle agglomeration.

Beyond providing potential defect formation sources, conventional polishing pad microtexture is not optimal because pad surface conditioning is typically not exactly reproducible. The diamonds on a conditioning disk become dulled with use such that the conditioner must be replaced after a period of time; during its life the effectiveness of the conditioner thus continually changes. Conditioning also contributes greatly to the wear rate of a CMP pad. It is common for about 95% of the wear of a pad to result from the abrasion of the diamond conditioner and only about 5% from contact with workpieces. Thus in addition to defect reduction, improved pad microstructure could eliminate the need for conditioning and allow longer pad life.

The key to eliminating pad conditioning is to devise a polishing surface that is self-renewing, that is, that retains the same essential geometry and configuration as it wears. Thus to be self-renewing, the polishing surface must be such that wear does not significantly reshape the solid regions. This in turn requires that the solid regions not be subjected to continuous shear and heating sufficient to cause a substantial degree of plastic flow, or that the solid regions be configured so that they respond to shear or heating in a way that distributes the shear and heating to other solid regions.

In addition to low defectivity, CMP pad polishing structures must achieve good planarization efficiency. Conventional pad materials require a trade-off between these two performance metrics because lower defectivity is achieved by making the material softer and more compliant, yet these same property changes compromise planarization efficiency. Ultimately, planarization requires a stiff flat material; while low defectivity requires a less stiff conformal material. It is thus difficult to surmount the essential trade-off between these metrics with a single material. Conventional pad structures approach this problem in a variety of ways, including the use of composite materials having hard and soft layers bonded to one another. While composites offer improvements over single-layer structures, no material has yet been developed that achieves ideal planarization efficiency and zero defect formation simultaneously.

Consequently, while pad microstructure and conditioning means exist for contemporary CMP applications, there is a need for CMP pad designs that achieve higher real contact area with the workpiece and more effective slurry flow patterns for removal of polish debris, as well as reducing or eliminating the need for re-texturing. In addition, there is a need for CMP pad structures that combine a rigid stiff structure needed for good planarization efficiency with a less stiff conformal structure needed for low defectivity.

STATEMENT OF THE INVENTION

An embodiment of the invention provides a polishing pad useful for polishing at least one of a magnetic, optical and semiconductor substrate in the presence of a polishing medium, comprising multiple layers of polishing filaments stacked on a base layer of polishing filaments, the multiple layers of polishing filaments having a sequential stacked formation with each layer of the polishing filaments being above and attached to at least one lower polishing filament, the multiple layers of polishing filaments being parallel to a polishing surface of the polishing pad and wherein individual polishing filaments of the multiple layers of polishing filaments are above an average of at least three filaments to form the polishing pad having an open lattice structure of interconnected polishing filaments.

Another embodiment of the invention provides a polishing pad useful for polishing at least one of a magnetic, optical and semiconductor substrate in the presence of a polishing medium, comprising multiple layers of polishing filaments stacked on a base layer of polishing filaments, the multiple layers of polishing filaments having a sequential stacked formation with each layer of the polishing filaments being above and attached to a lower polishing filament at each intersection between polishing filaments, the multiple layers of polishing filaments being parallel to a polishing surface of the polishing pad and wherein individual polishing filaments of the multiple layers of polishing filaments are polymeric and above an average of at least three filaments to form the polishing pad having an open lattice structure of interconnected polishing filaments.

DETAILED DESCRIPTION OF THE INVENTION

Figure 1:
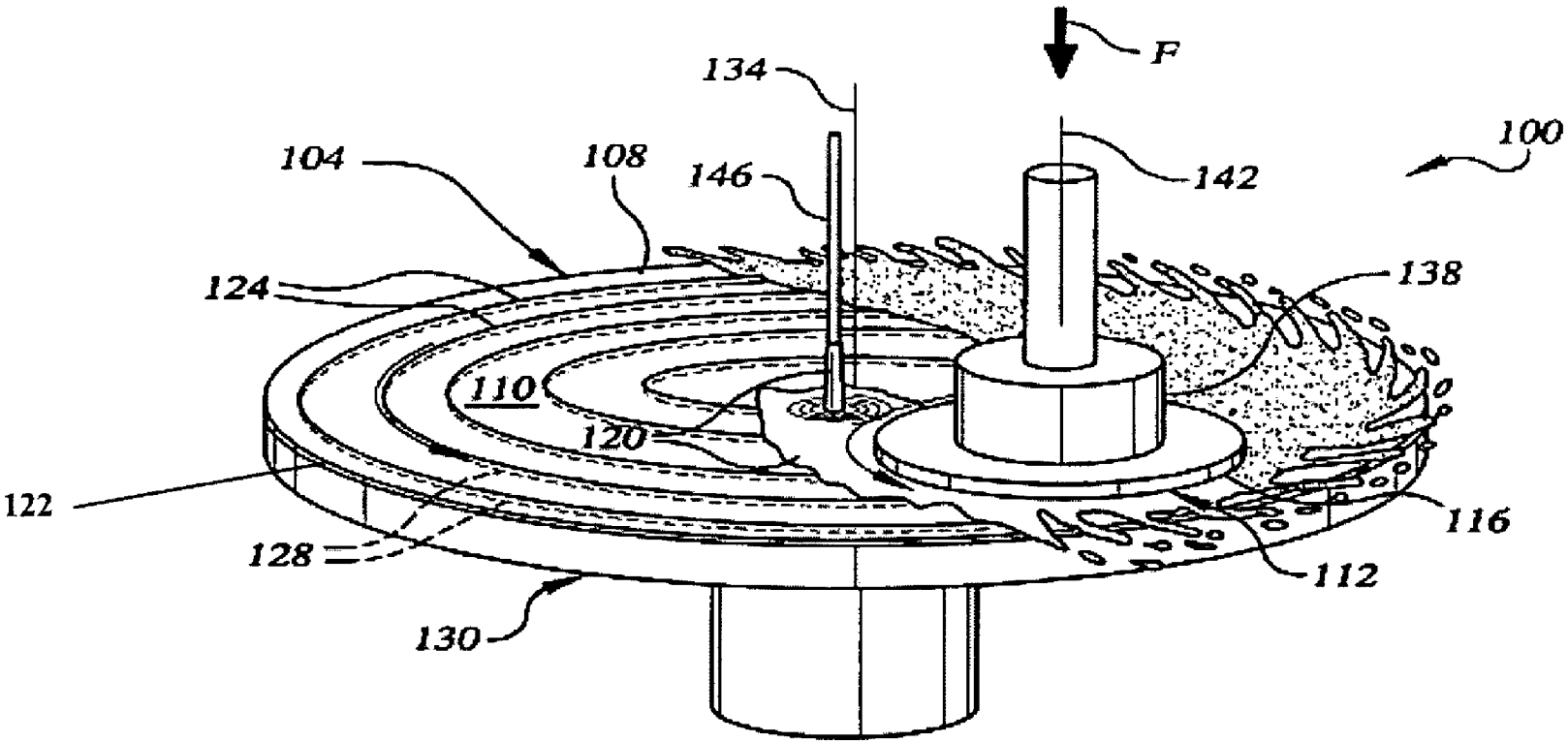
FIG. 1 is a perspective view of a portion of a dual-axis polisher suitable for use with the present invention.

Referring to the drawings, FIG. 1 generally illustrates the primary features of a dual-axis chemical mechanical polishing (CMP) polisher 100 suitable for use with a polishing pad 104 of the present invention. Polishing pad 104 generally includes a polishing layer 108 having a polishing surface 110 for confronting an article, such as semiconductor wafer 112 (processed or unprocessed) or other workpiece, e.g., glass, flat panel display or magnetic information storage disk, among others, so as to effect polishing of the polished surface 116 of the workpiece in the presence of a polishing medium 120. Polishing medium 120 travels to polishing pad perimeter 122 through optional spiral groove 124 having a depth 128. For the sake of convenience, the term "wafer" is used below without the loss of generality. In addition, as used in this specification, including the claims, the term "polishing medium" includes particle-containing polishing solutions and non-particle-containing solutions, such as abrasive-free and reactive-liquid polishing solutions.

Polisher 100 may include polishing pad 104 mounted on platen 130. Platen 130 is rotatable about a rotational axis 134 by a platen driver (not shown). Wafer 112 may be supported by a wafer carrier 138 that is rotatable about a rotational axis 142 parallel to, and spaced from, rotational axis 134 of platen 130. Wafer carrier 138 may feature a gimbaled linkage (not shown) that allows wafer 112 to assume an aspect very slightly non-parallel to polishing layer 108, in which case rotational axes 134, 142 may be very slightly askew. Wafer 112 includes polished surface 116 that faces polishing layer 108 and is planarized during polishing. Wafer carrier 138 may be supported by a carrier support assembly (not shown) adapted to rotate wafer 112 and provide a downward force F to press polished surface 116 against polishing layer 108 so that a desired pressure exists between the polished surface and the polishing layer during polishing. Polisher 100 may also include a polishing medium inlet 146 for supplying polishing medium 120 to polishing layer 108.

As those skilled in the art will appreciate, polisher 100 may include other components (not shown) such as a system controller, polishing medium storage and dispensing system, heating system, rinsing system and various controls for controlling various aspects of the polishing process, such as follows: (1) speed controllers and selectors for one or both of the rotational rates of wafer 112 and polishing pad 104; (2) controllers and selectors for varying the rate and location of delivery of polishing medium 120 to the pad; (3) controllers and selectors for controlling the magnitude of force F applied between the wafer and polishing pad, and (4) controllers, actuators and selectors for controlling the location of rotational axis 142 of the wafer relative to rotational axis 134 of the pad, among others.

During polishing, polishing pad 104 and wafer 112 are rotated about their respective rotational axes 134, 142 and polishing medium 120 is dispensed from polishing medium inlet 146 onto the rotating polishing pad. Polishing medium 120 spreads out over polishing layer 108, including the gap beneath wafer 112 and polishing pad 104. Polishing pad 104 and wafer 112 are typically, but not necessarily, rotated at selected speeds of 0.1 rpm to 150 rpm. Force F is typically, but not necessarily, of a magnitude selected to induce a desired pressure of 0.1 psi to 15 psi (6.9 to 103 kPa) between wafer 112 and polishing pad 104. It is possible to configure the polishing pad in a web format or into polishing pads having a diameter less than the diameter of the substrate being polished.

Figure 2:
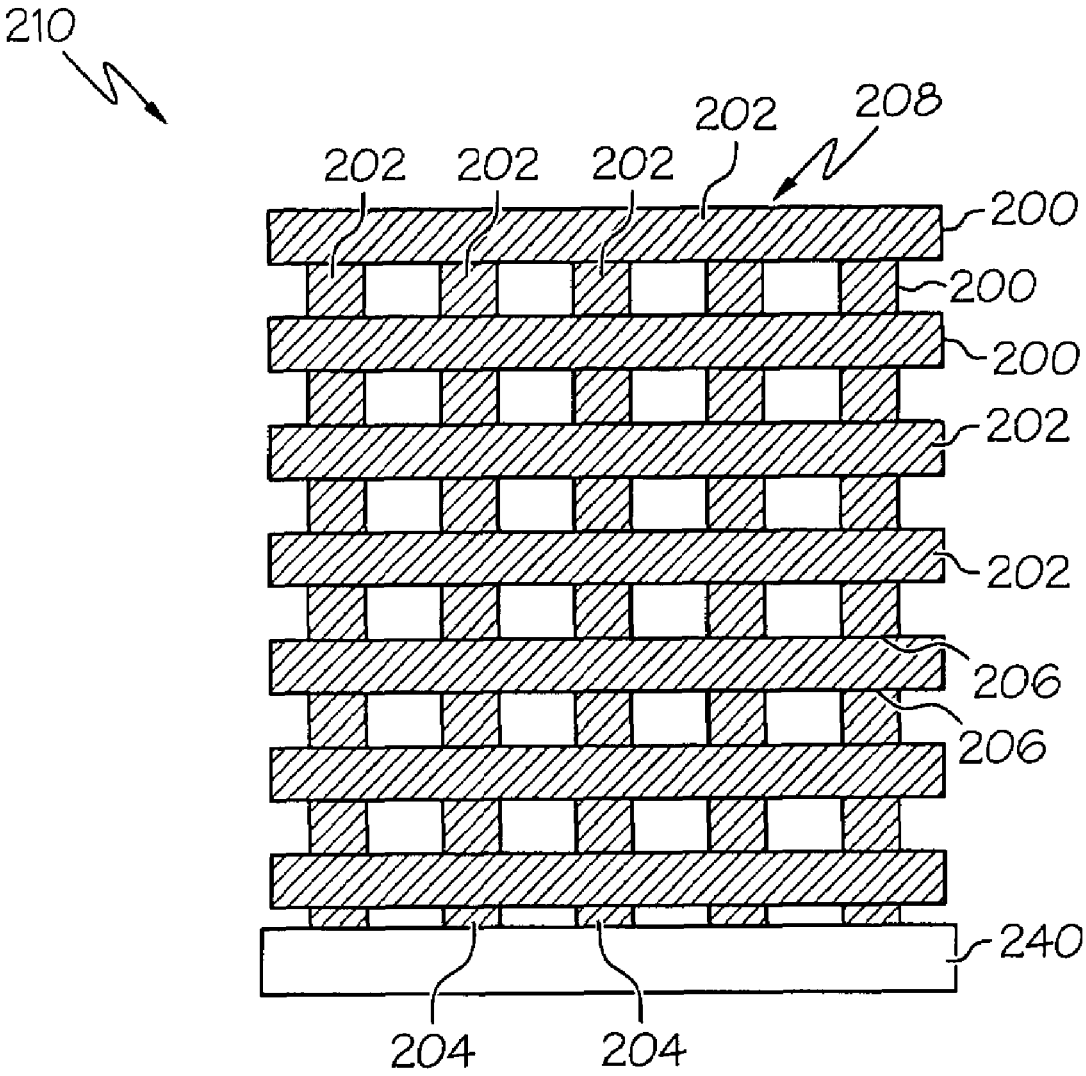
FIG. 2 is a front view of a layered filament polishing pad of the invention.
Figure 2A:
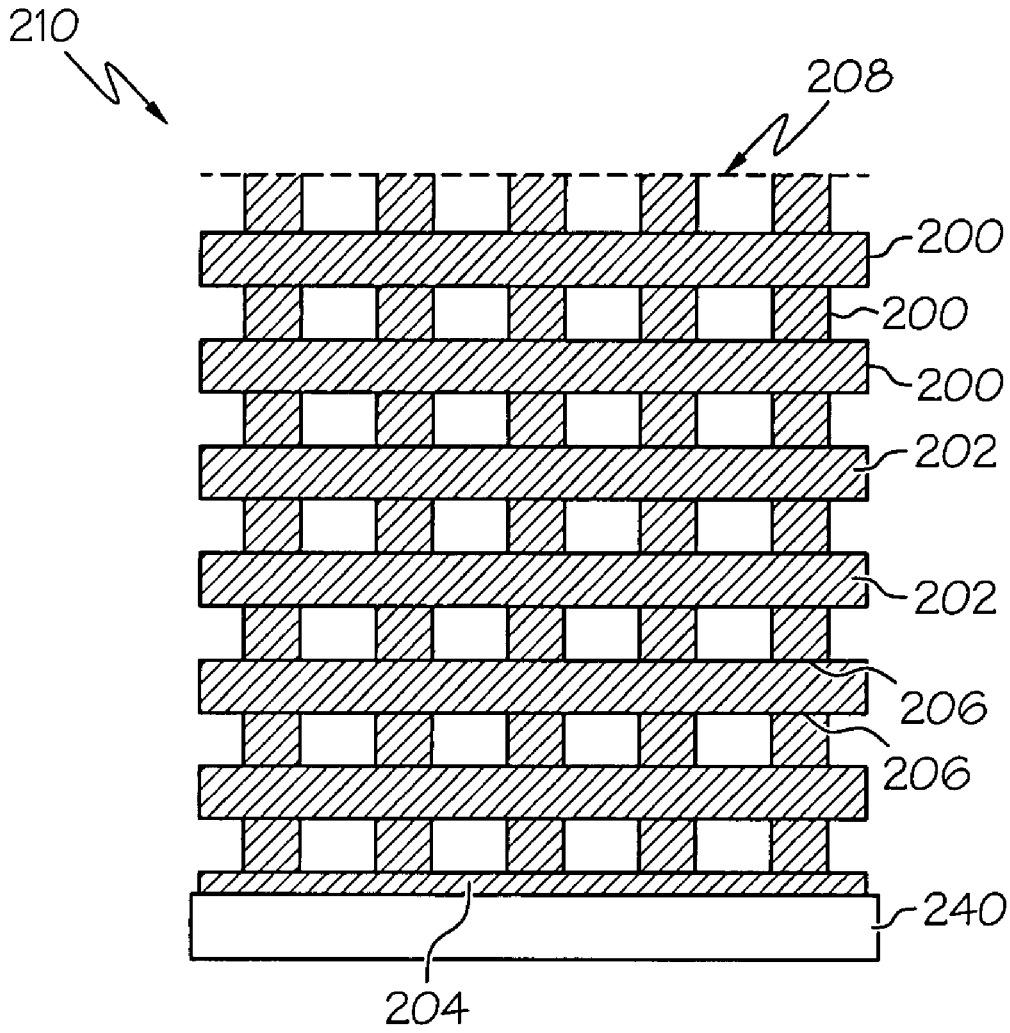
FIG. 2A is a side view of FIG. 2.
Figure 2B:
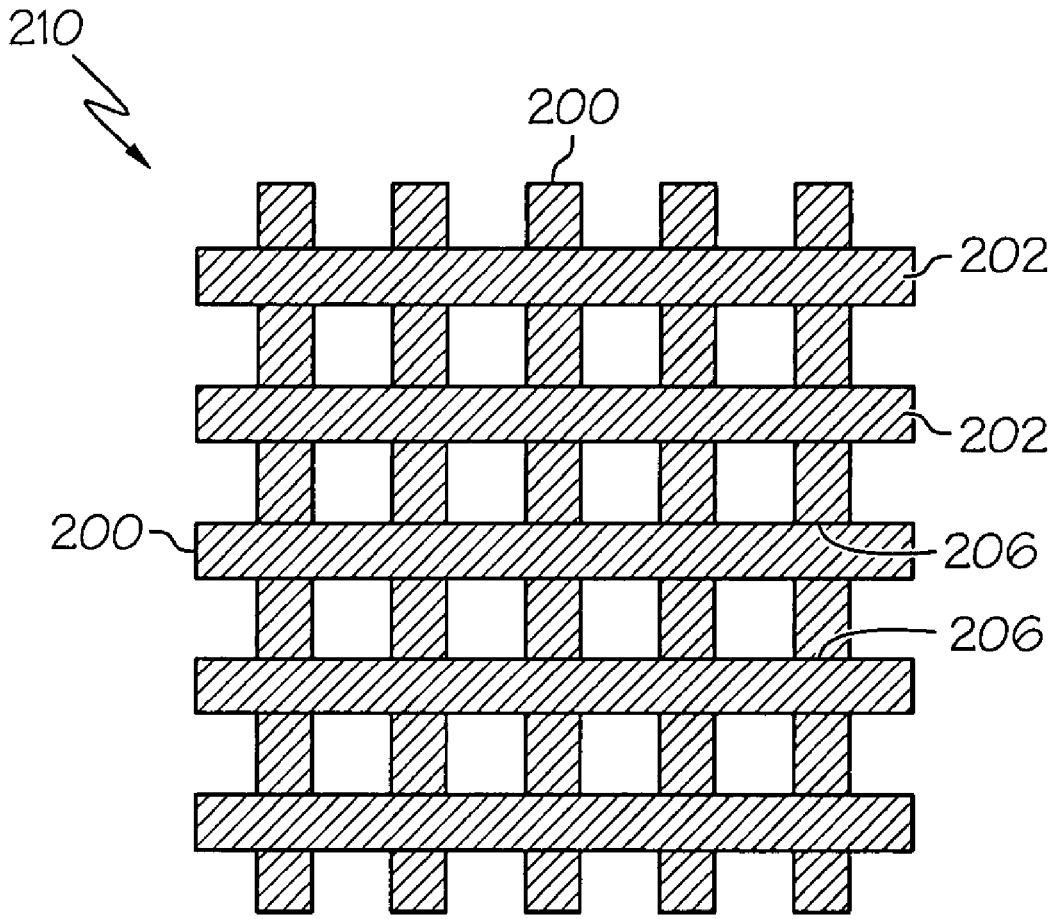
FIG. 2B represents a top view of FIG. 2.

The present invention includes providing polishing pad 104 useful for polishing at least one of a magnetic, optical and semiconductor substrate in the presence of a polishing medium. Referring to FIGS. 2 to 2B, the polishing pad 104 (FIG. 1) has multiple filament layers 200 of polishing filaments 202 (FIG. 2) stacked in a vertical arrangement on a base layer 204 of polishing filaments 202. Base layer 204 of polishing filaments 202 may be attached to a base material 240 that facilitates mounting of polishing pad 104 to the surface of platen 130 and adhesion thereto. Each sequential filament layer 200 of polishing filaments 202 above the base layer 204 is geometrically rotated in a horizontal plane parallel to its polishing surface 208 for support from and attachment to an underlying filament layer 200. For purposes of this specification, parallel to the polishing surface represents parallel to the overall presented surface of polishing pad 104 that confronts polished surface 116. The geometric rotation in a horizontal plane results in each filament layer 200 having a different direction than the filament layer 200 above and the filament layer 200 below, such that polishing filaments 202 of each layer 200 form an angle with the polishing filaments 202 of the filament layer 200 above and the filament layer 200 below.

Each polishing filament 202 advantageously has a length sufficient for support from at least three underlying polishing filaments 202. Advantageously, each polishing filament 202 has two ends, with each end at the perimeter of polishing pad 104. The extended linear shape of the polishing filaments 202 provides a very high surface area to volume ratio that facilitates heat dissipation during polishing. In this embodiment, each filament layer 200 is rotated 90° with respect to the filament layer 200 above in a plane parallel to the polishing surface 208, to form a sequential stack of filament layers 200 with the polishing filaments 202 secured at each intersection 206 to form polishing pad 104 having an open lattice structure 210 of interconnected polishing filaments 202. The polishing filaments 202 must secure with at least one intersection 206 to another polishing filament 202 for structural integrity. The open lattice structure 210 thereby constitutes an engineered structure of interconnected filaments 202. In alternative embodiments, it is possible to secure the polishing filaments at alternating intersections or at random intersections. But for the most consistent polishing performance, each intersection 206 attaches a lower polishing filament to an upper polishing filament. The interconnected open lattice structure 210 makes it possible to form a stiff polishing pad with local deformability at the polishing surface. This combination of stiffness and local deformability provides a capability of low-defect planarization not achieved with conventional pads. Furthermore, the open lattice structure 210 provides the advantage of improving fluid flow and heat dissipation over conventional pads having lower microstructures of lower void fraction and lower surface-to-volume ratio.

Figure 3:
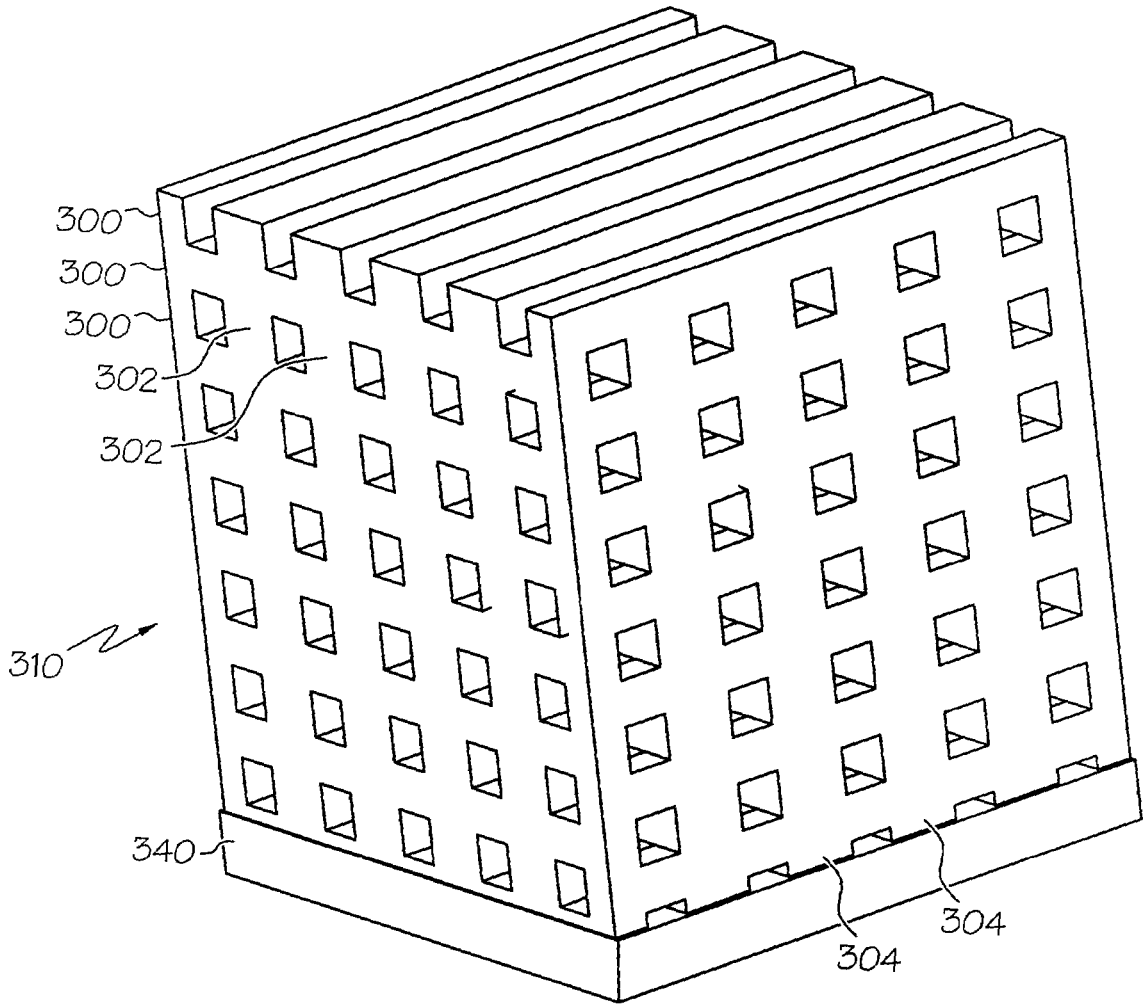
FIG. 3 represents a perspective view of a layered filament polishing pad of the invention.

FIG. 3 illustrates filament layers 300 that sequentially stack to form an open lattice network structure 310 having a high void fraction or percentage of open volume versus solid volume. Filament layers 300 form the polishing layer from a series of similar or identical macroscopic or microscopic polishing filaments 302 with each filament 302 constrained at multiple locations. Preferably, the polishing filaments 302 have microscopic dimensions to create a microtexture. Microscopic dimensions provide the further advantage of increasing the ratio of surface area to volume to facilitate heat dissipation from the points of contact. Typically, the filaments have an average width of less than 1 mm. Preferably, the filaments have a width of less than 0.2 mm (200 μm). It is possible to manufacture filaments as small as 10 μm in average width, but typically an average width of at least 100 μm provides sufficient stiffness for improved planarization. Optionally the filament layers 300 rest on a base filament layer 304. In addition there may be provided a base material 340.

Constraining the filaments 302 forms the open lattice structure interconnected in three dimensions to stiffen the lattice network structure 310 with respect to shear, bending, and compression. These features function in a way that imparts stiffness to the pad at the length scale required for good planarization efficiency while allowing compliance at the shorter length scales required for low defectivity. In addition, these features provide both higher real contact area between the pad and wafer and more favorable slurry flow patterns between the pad and wafer than are realized using conventional polishing pads, as well as providing a self-renewing structure that can eliminate the need for conventional diamond pad conditioning. For many applications, however, it is still desirable to condition with a brush, such as a polymeric brush, to remove debris.

In contrast to CMP pads of prior art in which surface texture or asperities are the residue of a material removal or reshaping process (i.e. conditioning), the pad's polishing texture is built as stacked layers of polishing filaments having a precise geometry. For purposes of illustration, the polishing texture is shown to consist of substantially horizontal elements parallel to the polishing surface. These filaments may have a circular, square, triangular, rectangular, polygonal or other cross-section. Square and rectangular cross-sections increase contact area during polishing relative to circular or triangular cross-sections of the same mean dimension. For purposes of this specification, contact area represents the area contacting an optically flat slide with a static downforce of 2 psi (13.8 kPa). Typical polishing pads built in accordance with the invention have a contact area of at least 10 percent as measured with confocal microscopy, using the technique disclosed in the paper "A Novel Optical Technique to Measure Pad-Wafer Contact Area in Chemical Mechanical Planarization" by C. L. Elmufdi and G. P. Muldowney, Proceedings of Material Research Society (MRS) Spring Meeting, 2006. For example, the polishing pads may have a contact area of 10 to 80 percent and advantageously 20 to 75 percent as measured with confocal microscopy. Increasing contact area during polishing is particularly useful for abrasive-free polishing solutions that rely upon contact with the asperities of a polishing pad to drive removal rate. Furthermore, the vertical sidewalls orthogonal to the polishing surface afforded by filaments having square or rectangular cross-sections provide uniform contact area as the pad wears, leading to more consistent polishing performance than that obtained with alternative filament cross-sections. Preferably, the average cross-section of the filaments varies less than 20% as the polishing pad wears through each layer of polishing filaments. Most preferably, the average cross-section of the filaments varies less than 10% as the polishing pad wears through each layer of polishing filaments.

Figure 4:
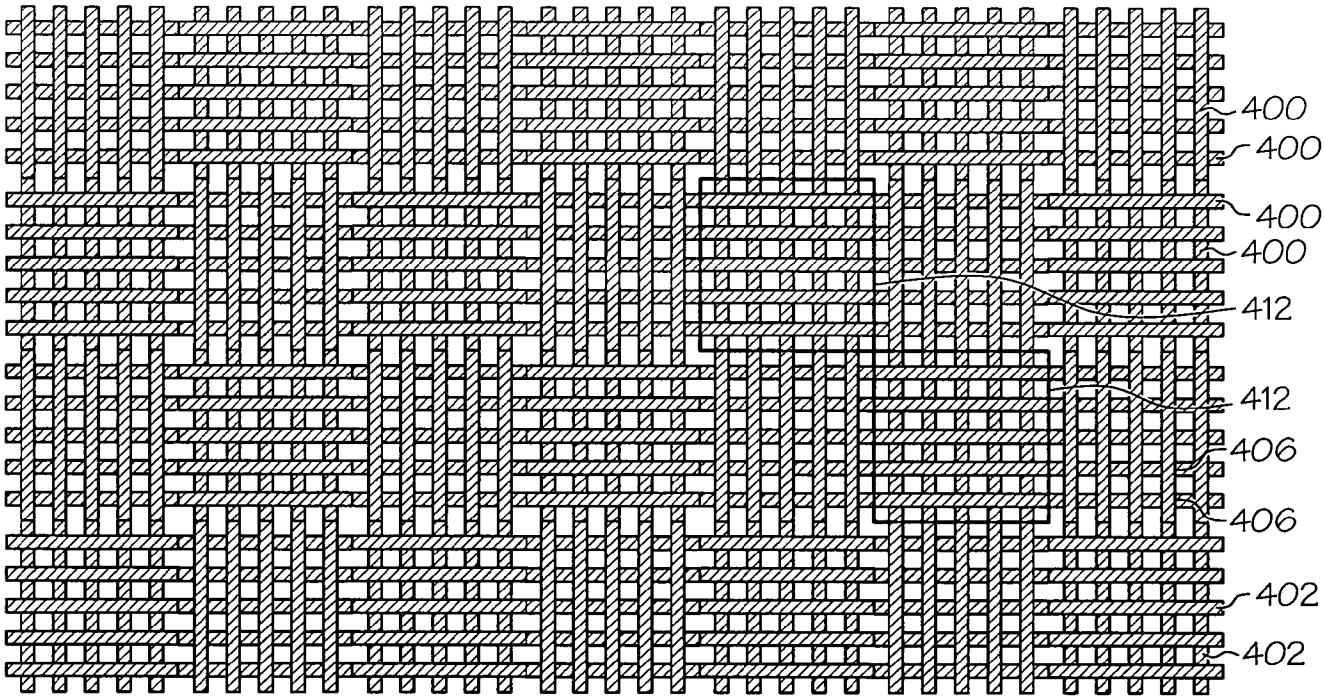
FIGS. 4 and 4A represent a top and side view of a layered filament polishing pad having alternating domains within a single structure.
Figure 4A:
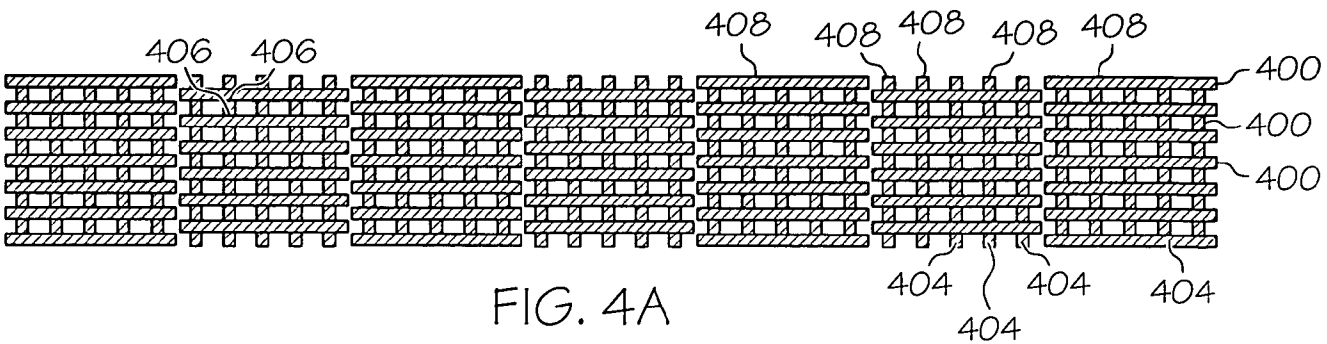

As the sequential layers of filaments wear, each layer of filaments becomes a new polishing surface with substantially constant contact area. The contact area is not changed if, within discrete domains of a given layer, the direction of the filaments is varied. Optionally, as illustrated in FIGS. 4 and 4A, the horizontal polishing filaments 402 within each filament layer 400 are arranged to form domains 412, such that within a given domain 412 all filaments 402 have substantially the same direction, but between domains 412 the direction of filaments 402 may differ. In particular, the direction of filaments 402 within one filament layer 400 are different in any two domains 412 that share a common boundary. Within each domain 412, layers of polishing filaments 400 sequentially stack on base layer 404 to form a consistent polishing surface 408. In contrast to the embodiment shown in FIGS. 2 to 2B, in which each polishing filament 202 has two ends, and each end is located at the perimeter of polishing pad 104, the polishing filaments 402 in the embodiment shown in FIGS. 4 and 4A have ends located at the edges of domain 412 when domain 412 is not at the perimeter of polishing pad 104 and ends located at the perimeter of polishing pad 104 when domain 412 is itself located at the perimeter of polishing pad 104 and is thus defined on at least one side by the circumference of polishing pad 104. The embodiment shown in FIGS. 4 and 4A provides the same benefits as the open lattice shown in FIGS. 2 to 2B with the additional feature that flow of the polishing liquid in any given filament layer 400 occurs simultaneously along multiple directions dictated by the different orientations of polishing filaments 402 in the various domains 412, in contrast to the flow of polishing liquid in any given filament layer 200 that occurs in a single direction dictated by polishing filaments 202.

Furthermore, perforations through the pad, the introduction of conductive-lined grooves or the incorporation of one or more conductors, such as conductive fibers, conductive network, metal grid or metal wire, can transform the pads into eCMP ("electrochemical mechanical planarization") polishing pads. These pads' three-dimensional network structure can facilitate fluid flow and maintain a consistent surface structure for demanding eCMP applications. The increased fluid flow improves the removal of spent electrolyte from the eCMP process that can improve uniformity of the eCMP process.

Figure 5:
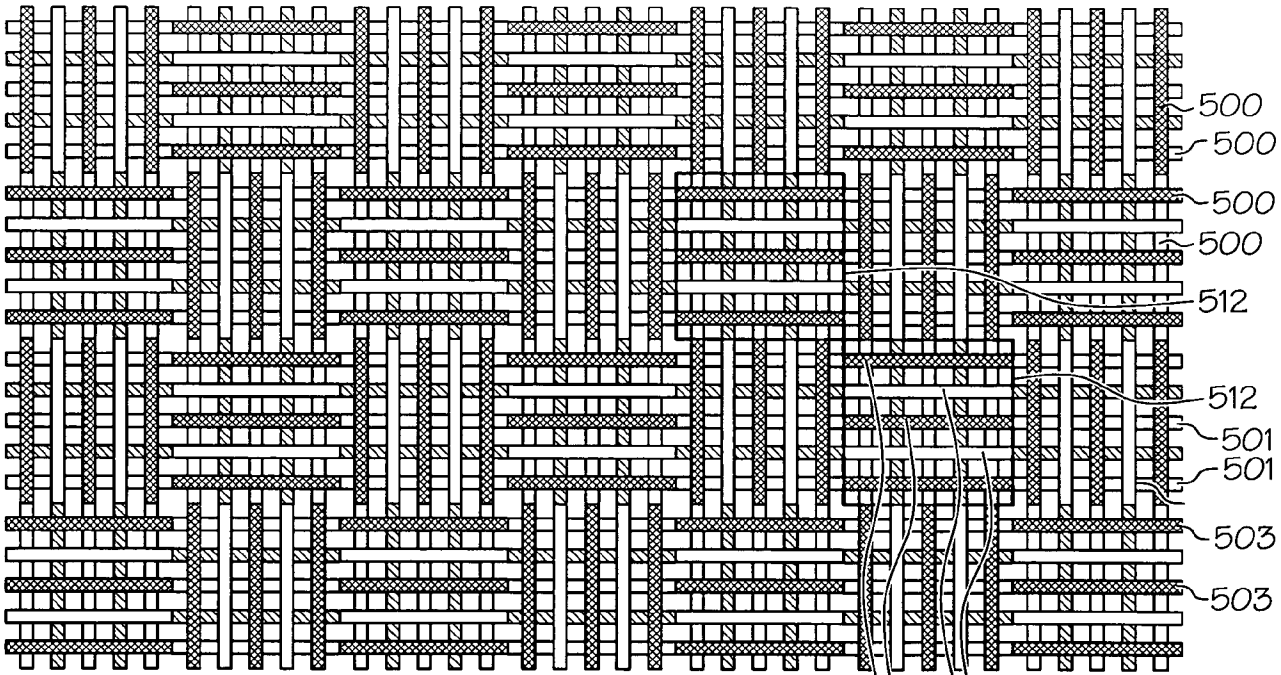
FIGS. 5 and 5A represent a top and side view of a layered filament polishing pad having alternating conductive and non-conductive filaments useful for electropolishing.
Figure 5A:
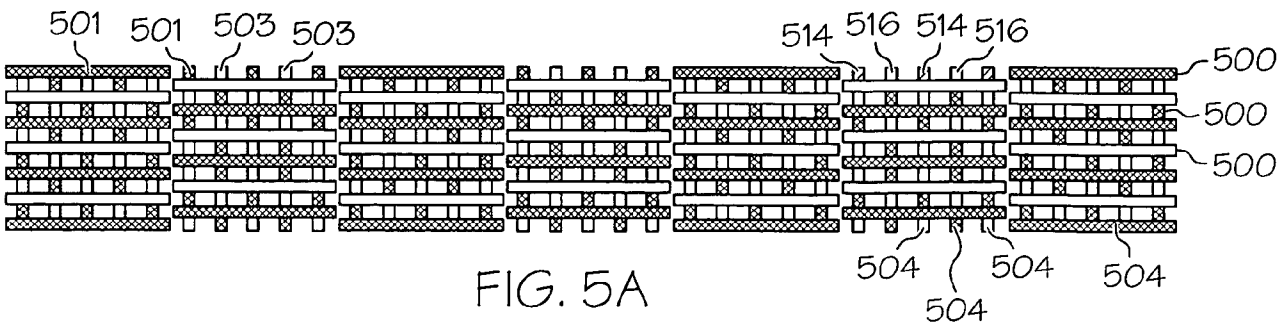

FIGS. 5 and 5A illustrate an example eCMP polishing pad fabricated from layers of polishing filaments 500. Each layer of polishing filaments 500 contains alternating conductive filaments 501 and non-conductive filaments 503. The conductive filaments 501 and non-conductive filaments 503 are further organized into domains 512. To form the eCMP pad, it is possible to place charge on the wafer and a charge on the conductive filaments 501. The electro-potential between the conductive filaments 501 and the wafer facilitates the electro-dissolution of metal surfaces on the wafer. Optionally, domains 512 are further divided into alternating anodes 514 and cathodes 516 to create a local potential between the filaments within each domain. This potential between filaments can also drive the electro-dissolution of metal for eCMP. Optionally, not shown in FIGS. 5 and 5A, all of the filaments within a given domain 512 may be of a material suitable as a cathode and all of the filaments within the adjacent domain 512 may be of a material suitable as an anode. This configuration may be used to create a local potential between adjacent domains 512 to drive the electro-dissolution of metal for eCMP, but at a length scale greater than that achieved when alternating anodic and cathodic filaments are arranged within a single domain 512.

Figure 6:
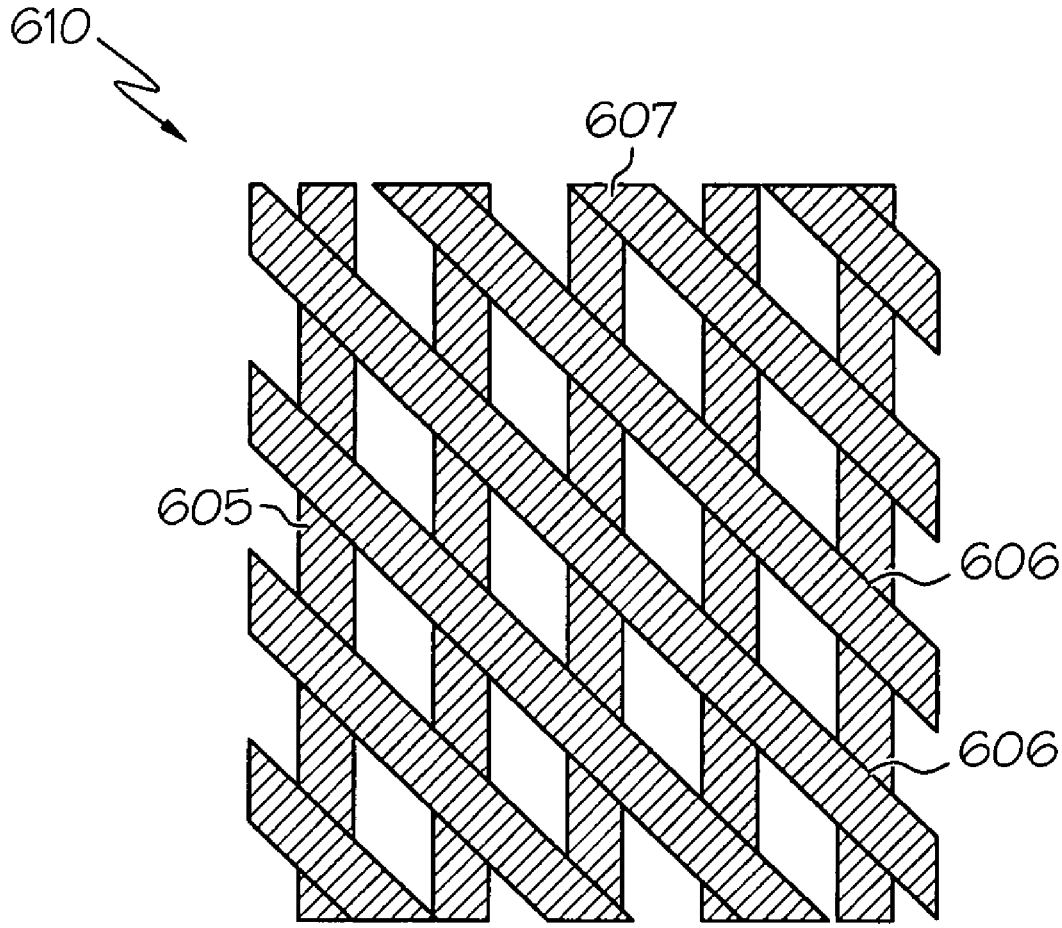
FIG. 6 illustrates a top view of a layered filament polishing pad having angled filaments.

FIG. 6 illustrates a polishing lattice 610 with upper polishing filament layer 607 rotated 45° in horizontal plane above lower polishing filament layer 605. An advantage of the 45° rotation is that intersections 606 have increased surface area for stronger bonds and support relative to the intersections formed by filaments of the same size crossing at 90°. Advantageously, the polishing filament layers 605 and 607 have seamless connections to provide continuous material between the filament layers.

The invention comprehends not only regular layered lattices but also irregular ones. Lattices may be irregular in several ways. First, the spacing of the parallel members within a given layer may be periodic, random, or otherwise unequal. Second, the thicknesses of the layers may be unequal. Third, the offsetting angle between the principal direction of the members in different layers may vary. Fourth, the domains of locally parallel elements, if present, within any given layer may be of various sizes rather than the identical sizing shown in FIG. 5. Fifth, the filaments may have a curved, wavy, or helical pattern.

It is preferred that width and pitch of the polishing filaments be uniform, or nearly so, across the entire polishing pad, or uniform across domains of polishing filaments. Optionally, it is possible to adjust the density of the polishing filaments in different regions to fine tune removal rates and polishing or wafer uniformity. Furthermore, it is possible to arrange the polishing elements in a manner that forms open channels or grooves, such as circular channels, X-Y channels, radial channels, curved-radial channels or spiral channels. The optional introduction of the channels facilitates removal of large debris and can improve polishing or wafer uniformity.

The dimensions and spacing of polishing filaments are chosen to provide both high contact area between the pad and wafer and adequate open flow area for slurry to remove polish debris. There is an intrinsic trade-off between these objectives: adding more polishing filaments, or larger filaments, in the available space of polishing texture augments the total contact area, but reduces the open flow area and creates more obstacles to the removal of polish debris by the slurry. In addition, reducing the cross-section of the polishing filaments acts to reduce the propensity of the wafer to hydroplane on the pad and reduces stiction between the polishing pad and wafer. Optionally, the polishing filaments constitute less than 80 percent of the polishing pad volume measured above the base layer. For example, the polishing filaments may constitute less than 75 percent of the polishing pad volume measured above the base layer; and typically polishing filaments will occupy 5 to 75 percent of the polishing pad volume measured above the base layer. Polishing pads designed for high contact area typically occupy 40 to 80 percent of the polishing pad volume measured above its base layer.

Since an essential feature of the present invention is a favorable balancing of contact area and flow area, the polishing filaments must be appropriately slender and properly spaced. In general, for filaments of square cross-section having a width w and a pitch p (measured from center to center), the contact area fraction confronting the wafer is (w/p) and the flow area fraction within a given filament layer is (1-w/p). The ratio of the width of polishing filaments to the pitch of polishing filaments may optionally be at most 0.8, corresponding to 80% contact area fraction and 20% flow area fraction, and preferably at most 0.6, corresponding to 60% contact area fraction and 40% flow area fraction. For example, filaments with an equal width and filament spacing have a width to pitch ratio of 0.5, corresponding to a contact area fraction and flow area fraction both equal to 50%. In some applications it will be desirable to have very large flow area, for example a ratio of filament width to filament pitch of 0.2, corresponding to 20% contact area fraction and 80% flow area fraction. It is noteworthy that even 20% contact area fraction is significantly greater than that realized with conventional polishing pad materials even after diamond conditioning.

Typically, polishing filaments arranged in a lattice also act to collect or trap polishing debris at a location below the surface of the pad. This feature facilitates a decrease in defectivity by trapping harmful debris in a location that will not contact or scratch the surface of an article during polishing. In addition, the filaments also advantageously have a sufficiently large spacing between them that local deformation and plastic flow of the filaments due to the frictional heat generated during polishing is insufficient to bridge the gap between filaments.

Optionally, polishing slurry flow is further optimized by choosing the cross-sectional shape of polishing filaments to be streamlined with respect to slurry flow that occurs predominantly in the horizontal direction. Streamlining of bodies to achieve minimum fluid drag is a well-established discipline of engineering and forms part of the science routinely applied in the design of aircraft, watercraft, automobiles, projectiles, and other objects that move in or relative to a gas or liquid. The equations of fluid flow governing these latter human-scale objects apply identically at the scale of CMP pad macrostructure or microstructure. In essence streamlining consists of choosing a gradually curved cross-section free of sharp transitions such that an external fluid flow may pass around the cross-section without separating from the surface and forming recirculating eddies that consume fluid energy. From this consideration alone, a circular cross-section would be preferred over a square or rectangular cross-section for polishing filaments. However a square or rectangular cross-section is preferred to minimize variations in contact area during wear of the filaments. Optionally the filaments may have a cross-section which balances these two objectives, such as a square with rounded corners that allows small contact area variations, for example less than 20%, while realizing some of the benefits of streamlining.

The polishing pad may optionally include a subpad. It is noted that a subpad is not required and that the polishing layer may be secured directly, via base layer, to a platen of a polisher, e.g., platen 130 of FIG. 1. Polishing layer may be secured, via base layer, to a subpad in any suitable manner, such as adhesive bonding, e.g., using a pressure sensitive adhesive layer or hot-melt adhesive, heat bonding, chemical bonding, ultrasonic bonding, etc. The base layer or subpad may serve as the polishing base for attachment of the polishing elements.

Various methods of manufacture are possible. For larger-scale networks, these include micromachining, laser or fluid-jet etching, and other methods of material removal from a starting solid mass; and focused laser polymerization, filament extrusion, fiber spinning, preferential optical curing, biological growth, and other methods of material construction within an initially empty volume. For smaller-scale networks, crystallization, seed polymerization, lithography or other techniques of preferential material deposition may be employed, as well as electrophoresis, phase nucleation, or other methods of establishing a template for subsequent material self-assembly.

The polishing filaments may be made of any suitable material, such as polycarbonates, polysulfones, nylons, polyethers, polyesters, polystyrenes, acrylic polymers, polymethyl methacrylates, polyvinylchlorides, polyvinylfluorides, polyethylenes, polypropylenes, polybutadienes, polyethylene imines, polyurethanes, polyether sulfones, polyamides, polyether imides, polyketones, epoxies, silicones, copolymers thereof (such as, polyether-polyester copolymers), and mixtures thereof. Polishing filaments may also be made of a non-polymeric material such as ceramic, glass, metal, stone, wood, or a solid phase of a simple material such as ice. Polishing filaments may also be made of a composite of a polymer with one or more non-polymeric materials.

In general, the choice of material for polishing filaments is limited by its suitability for polishing an article made of a particular material in a desired manner. Similarly, the subpad may be made of any suitable material, such as the materials mentioned above for the polishing filaments. The polishing pad may optionally include a fastener for securing the pad to a platen, e.g., platen 130 of FIG. 1, of a polisher. The fastener may be, e.g., an adhesive layer, such as a pressure sensitive adhesive layer, hot melt adhesive, a mechanical fastener, such as the hook or loop portion of a hook and loop fastener. It is also within the scope of the invention to implement one or more fiber-optic endpointing devices or similar transmission devices that occupy one or more of the void spaces of the lattice structure.

The invention provides the advantage of increasing contact area in combination with a polishing pad's stiffness. In particular, it provides a high contact surface area with effective fluid flow within the pad to easily remove polishing debris. In addition, it allows adjustment of the polishing filaments' stiffness, height and pitch to control contact mechanics with a substrate. Furthermore, the polishing filaments' uniform cross-sectional area allows polishing of multiple substrates, such as patterned wafers with similar polishing characteristics. Finally, the application of a lattice structure for stiffness and local deformability at the surface provides the capability of low defect planarization not achieved with conventional pads.

The invention claimed is:

1. A polishing pad useful for polishing at least one of a magnetic, optical and semiconductor substrate in the presence of a polishing medium, comprising multiple layers of polishing filaments stacked on a base layer of polishing filaments, the multiple layers of polishing filaments having a sequential stacked formation with each layer of the polishing filaments being above and attached to at least one lower polishing filament, the multiple layers of polishing filaments being parallel to a polishing surface of the polishing pad and wherein individual polishing filaments of the multiple layers of polishing filaments are above an average of at least three polishing filaments to form the polishing pad having an open lattice structure of interconnected polishing filaments and the polishing pad provides uniform contact area as the polishing pad wears.

2. The polishing pad of claim 1 wherein a polymeric material forms the layers of polishing filaments and the individual polishing filaments have an average width of less than 1 mm.

3. The polishing pad of claim 1 wherein the individual polishing filaments have vertical sidewalls orthogonal to the polishing surface of the polishing pad.

4. The polishing pad of claim 3 wherein the individual polishing filaments have a square or rectangular cross-section and the average cross-section of the polishing filaments varies less than 20% as the 20% polishing pad wears through each layer of polishing filaments.

5. The polishing pad of claim 1 wherein the polishing pad has a perimeter and the individual polishing filaments have two ends that each end at the perimeter.

6. A polishing pad useful for polishing at least one of a magnetic, optical and semiconductor substrate in the presence of a polishing medium, comprising multiple layers of polishing filaments stacked on a base layer of polishing filaments, the multiple layers of polishing filaments having a sequential stacked formation with each layer of the polishing filaments being above and attached to a lower polishing filament at each intersection between polishing filaments, the multiple layers of polishing filaments being parallel to a polishing surface of the polishing pad and wherein individual polishing filaments of the multiple layers of polishing filaments are polymeric and above an average of at least three polishing filaments to form the polishing pad having an open lattice structure of interconnected polishing filaments and the polishing pad provides uniform contact area as the polishing pad wears.

7. The polishing pad of claim 6 wherein the open lattice structure has alternating conductive and non-conductive filaments.

8. The polishing pad of claim 6 wherein a polymeric material forms the layers of polishing filaments and the individual polishing filaments have an average width of less than 0.2 mm.

9. The polishing pad of claim 6 wherein the individual polishing filaments have vertical sidewalls orthogonal to the polishing surface of the polishing pad and the individual polishing filaments have a square or rectangular cross-section and the average cross-section of the Polishing filaments varies less than 10% as the polishing pad wears through each layer of polishing filaments.

10. The polishing pad of claim 6 wherein the polishing pad has a perimeter and the individual polishing filaments have two ends that each end at the perimeter.

* * * * *